US005143013A

United States Patent [19]

Huebner

[11] Patent Number: 5,143,013

[45] Date of Patent: Sep. 1, 1992

[54] CENTER CONSOLE INCLUDING STORAGE LOCKER

[75] Inventor: Peter B. Huebner, Cape Coral, Fla.

[73] Assignee: Outboard Marine Corporation, Waukegan, Ill.

[21] Appl. No.: 693,940

[22] Filed: Apr. 29, 1991

[51] Int. Cl.[5] ..... B65D 1/22

[52] U.S. Cl. ..... 114/343; 114/361

[58] Field of Search ..... D12/300, 315, 317, 318; 114/343, 361, 364, 267, 71, 144 R, 188, 189, 270; 224/273, 276, 277; 296/37.12, 74; 108/25, 26; 220/345; 49/413; 52/206, 207

[56] References Cited

U.S. PATENT DOCUMENTS

| | | | |
|---|---|---|---|
| D. 192,397 | 3/1962 | Cohen | D71/1 |
| D. 251,778 | 5/1979 | Trabue, Jr. | D17/70 |
| D. 262,009 | 11/1981 | Bednar | D12/318 |
| 4,064,584 | 12/1977 | Funkhouser | 114/85 |
| 4,194,585 | 3/1980 | Prince | 296/70 |
| 4,253,537 | 3/1981 | Intveld | 296/70 |
| 4,549,625 | 10/1985 | Tindall | 296/30 |
| 4,706,810 | 11/1987 | Petrilli | 114/343 |
| 4,759,568 | 7/1988 | Paefgen | 296/70 |
| 4,957,056 | 9/1990 | Martin | 114/361 |
| 4,989,535 | 2/1991 | Lacasse | 114/347 |

OTHER PUBLICATIONS

1990 Donzi Portfolio Catalogue.
Chris-Craft 1990 Fishing Boats Catalogue.
Grady White Boats 1990 Catalogue.
1989 Four Winns Catalogue.
1990 Lowe Aluminum Boats Catalogue.
Sea-Ray 1990 Model Line Catalogue.
1989 Hydra-Sports Sportfishing Boats Catalogue.

*Primary Examiner*—Joseph F. Peters, Jr.
*Assistant Examiner*—Clifford T. Bartz
*Attorney, Agent, or Firm*—Michael, Best & Friedrich

[57] ABSTRACT

The invention comprises a center console for a boat having a front side, a back side, a left side and a right side, each of the sides having a generally vertical wall on at least the lower portion thereof and defining a space therein, said back side having a horizontally inclined shelf above the vertical wall and first and second generally parallel vertically inclined walls extending upwardly from the shelf, the second vertically inclined wall being stepped forwardly from the first vertically inclined wall and having an opening, and a door filling the opening when in a closed position and being in the space directly behind the first vertically inclined wall when in an open position. The invention also comprises a modular storage enclosure for a boat adapted to hold a fire extinguisher, a flare gun kit and navigational charts.

9 Claims, 2 Drawing Sheets

Fig. 1
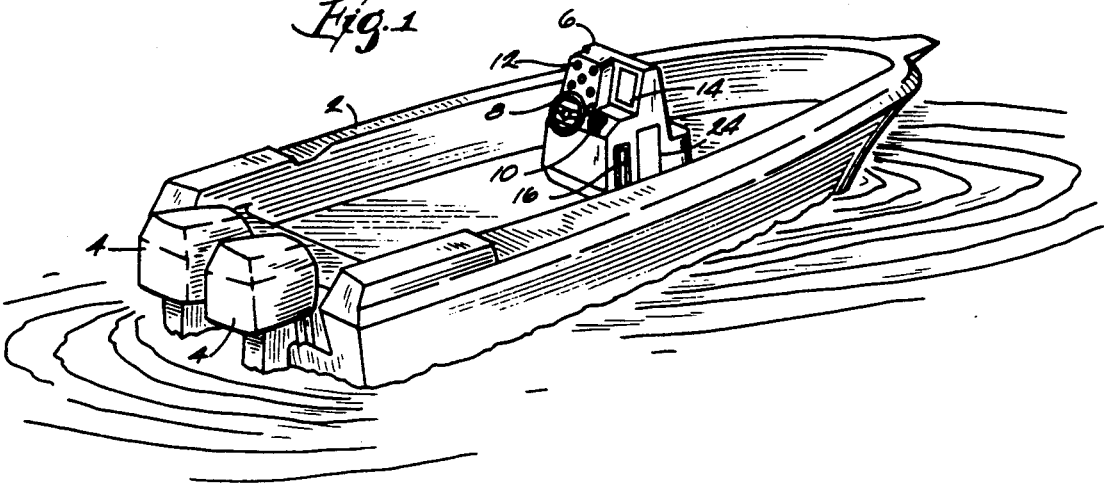
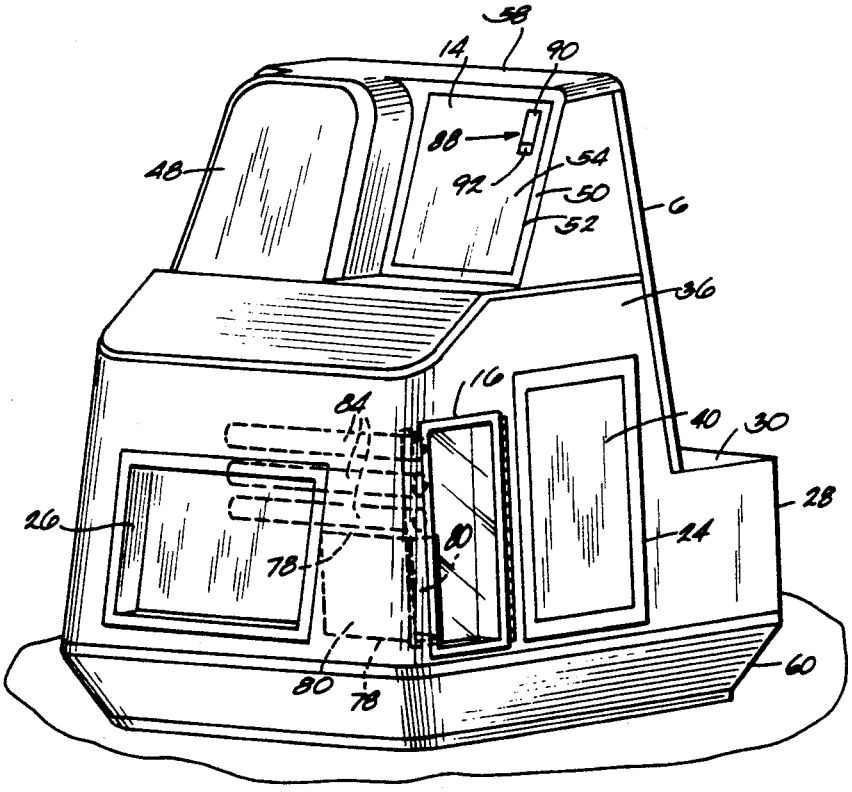
Fig. 2

CENTER CONSOLE INCLUDING STORAGE LOCKER

BACKGROUND OF THE INVENTION

This invention relates to storage lockers for boats, including a center console having a unique electronic instrument storage arrangement and a modular safety equipment storage enclosure for that console.

Other boat center consoles and enclosures are found in the following patents:

| PAT. NO. | INVENTOR(S) | ISSUE DATE |
|---|---|---|
| 1. 4,064,584 | Funkhouser, J. H. | 12/27/77 |
| 2. Des.192,397 | Cohen, R. | 3/13/62 |
| 3. Des.251,778 | Trabue, T. M. | 5/8/79 |
| 4. Des.262,009 | Bednar, C. | 11/24/81 |

In addition, other center consoles are shown in the following publications:

1. 1990 Donzi Portfolio, especially pages 34–37 and 42–43; and
2. Chris-Craft 1990 Fishing Boats, especially pages 4–5 and 10–11;
3. Grady White Boats 1990 Catalogue, especially page 20 thereof;
4. 1989 Four Winns Catalogue, especially pages 36 and 37 thereof;
5. 1990 Lowe Aluminum Boats Catalogue, especially page 3 thereof;
6. Sea-Ray 1990 Model Line, especially pages 4 and 5 thereof; and
7. 1989 Hydra-Sports Sportfishing Boats Catalogue.

SUMMARY OF THE INVENTION

The invention comprises a center console for a boat having a front side, a back side, a left side and a right side, each of the sides having a generally vertical wall on at least the lower portion thereof and defining a space therein, said back side having a horizontally inclined shelf above the vertical wall and first and second generally parallel vertically inclined walls extending upwardly from the shelf, the second vertically inclined wall being stepped forwardly from the first vertically inclined wall and having an opening, and a door filling the opening when in a closed position and being in the space directly behind the first vertically inclined wall when in an open position.

In a preferred embodiment, the invention also comprises a generally horizontal seat above the vertical wall on the front side. Also in a preferred embodiment, the first vertically inclined wall is substantially solid and is adapted to carry engine instruments.

In another embodiment, the center console also contains a recessed modular enclosure for storage of safety equipment, and one of the sides of the console has a cutout for access to the space within the walls.

In another embodiment, the recessed enclosure is covered by a door and contains space for storage of a fire extinguisher and a navigational chart.

In one embodiment, the first vertically inclined wall is adapted to carry engine instruments.

In another embodiment, the horizontally inclined wall is adapted to carry a steering wheel and a throttle and gear shift lever.

The invention also comprises a modular storage enclosure for a boat comprising a first volume having a rectangular lip around the front, and a back wall. At least one open ended cylinder, adapted to hold a rolled up navigational chart, has one end fixed to the back wall and extends rearwardly from the back wall. A second recessed volume extends rearwardly from the back wall and is adapted to hold a flare gun kit. A door is hingedly attached to the front lip.

In one embodiment, the modular storage enclosure has a seal between the lip and the door for keeping water from entering the enclosure.

In one embodiment, this modular storage enclosure is positioned in one of the side walls of the center console.

It is a feature of the invention to provide storage areas for electronic instruments and safety equipment in a boat having a center console which are lockable when the boat is unattended but which allow ready and convenient access to the electronics and safety equipment when the boat is in use.

It is a further feature of the invention to provide a center console of a boat in which the engine instruments are positioned in clear sight of the boat operator and the electronic positioning instruments and radio are kept in a separate lockable space also in direct view of the operator. Moreover, this door will slide conveniently out of the way of the operator or a passenger while the electronic instruments are in use.

It is a further feature of the invention to provide an enclosure which is modular, and thus easily installed into a center console or bulkhead, and which is adapted to hold certain safety equipment for the boat.

BRIEF DESCRIPTION OF THE DRAWINGS

FIG. 1 is a perspective view of a boat having a center console constructed according to the claims of the invention.

FIG. 2 is a more detailed perspective view of the center console and the modular storage enclosure.

Figures 3, 4, 5:
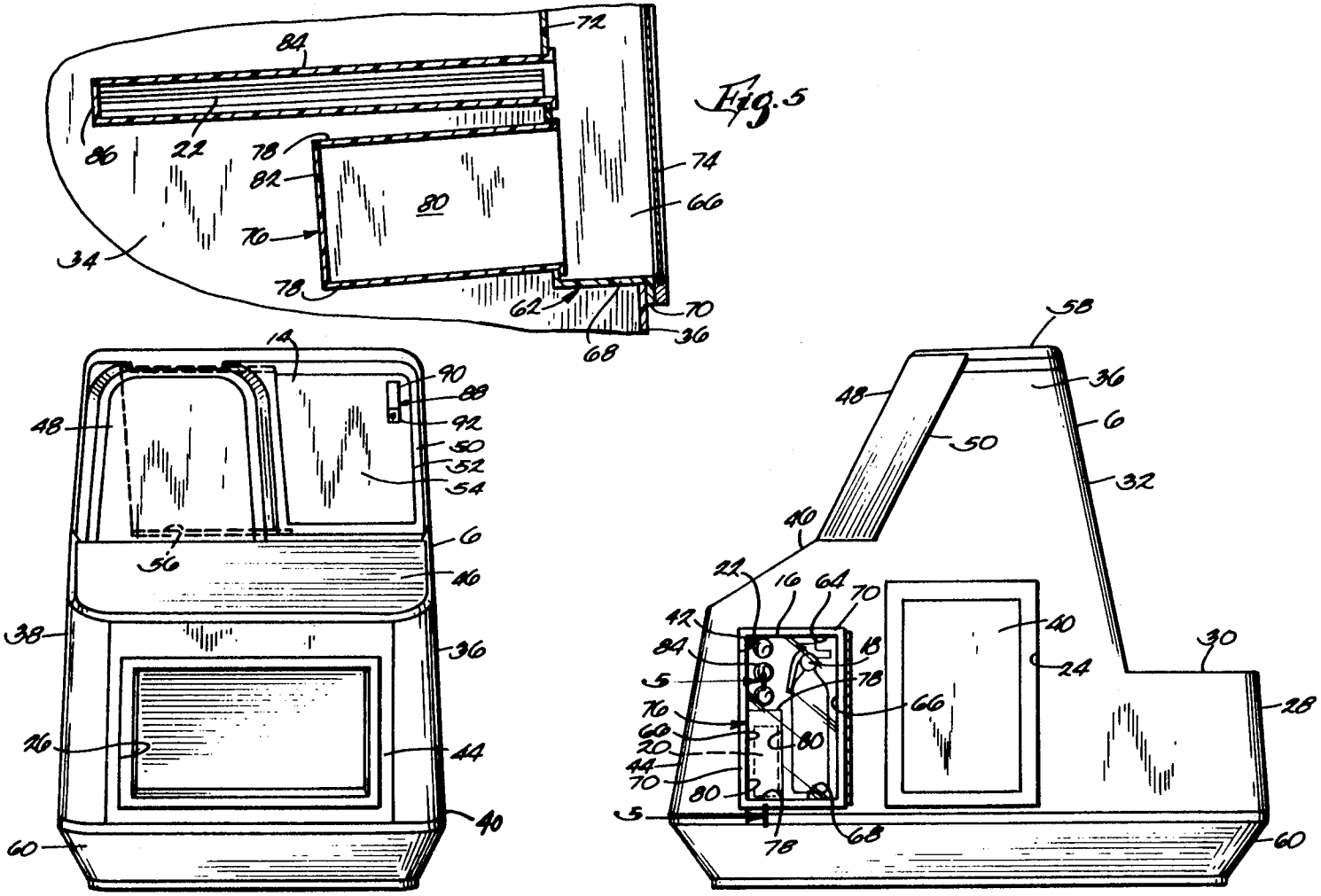
FIG. 3 is a rear elevational view of the center console.
FIG. 4 is a side elevational view of the center console and the modular storage enclosure.
FIG. 5 is a view taken along line 5—5 of FIG. 4 showing details of the modular storage enclosure.

Before explaining one embodiment of the invention in detail, it is to be understood that the invention is not limited in its application to the details of the construction and the arrangements of the components set forth in the following description illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Shown in FIG. 1 is a boat 2 having a pair of outboard motors 4 adapted to propel it through the water. The outboard motors 4 are controlled by an operator positioned at or around the center console or control station 6 embodying various features of the invention.

In a preferred embodiment, the center console 6 is positioned in the cockpit of the boat and provides a location for a steering wheel 8 which is operatively connected to control the pivotal steering motion of the outboard motors. The center console also provides a location for a single lever control 10 which controls both the forward-neutral-reverse transmission of the motors and the throttle. The console is also adapted to display numerous engine indication instruments 12. These instruments include, but are not limited to, a tachometer, oil pressure gauge, engine temperature gauge, trim position indicator, electric charge indicator and speedometer.

The boat 2 is equipped with a console 6 having a unique combination of storage areas for electronic instruments and safety equipment. The console 6 is adapted to house electronic position indicating instrumentation and radios 14 for the boat behind a sliding closeable and lockable door 54. This electronic instrumentation may include, but is not limited to a compass, a ship-to-shore radio, a depth sounder and a loran. The center console 6 also comprises a modular storage enclosure 16 for storing certain safety equipment. In a preferred embodiment, this modular storage enclosure comprises space for storing a fire extinguisher 18, a flare gun kit 20, and at least three rolled up navigational charts 22.

The center console 6 also comprises at least one major opening 24 or 26 for access to the volume of space 34 within the center console. These major openings 24 and 26 will preferably be covered by access doors which cover the opening when closed. Via access through these major openings, 24 and 26, the central space in the center console can be adapted to store larger items such as life jackets and fishing tackle boxes.

In a preferred embodiment, the front of the center console, as best seen in FIGS. 2 and 4, comprises a lower vertical wall 28 which supports the front end of a horizontal seat 30. Above the horizontal seat extends an inclined vertical wall 32 which acts as the front of the upper portion of the console and the back of the seat. In a preferred embodiment, a cushion (not shown) may be positioned directly upon the horizontal seat 30.

The center console further comprises a right side having a wall 36 and a left side also having a wall 38. In a preferred embodiment, the side opening 24 is cut out of the right side wall 36 and a door 40 may be positioned to cover the opening when closed. Also, in a preferred embodiment, the modular storage enclosure 16 is positioned in an aperture 42 in the right side wall 36 so that it extends into the space 34 inside the console 6.

The center console also comprises a back side which comprise a lower vertical wall 44 and a horizontally inclined shelf 46 above the lower wall. In a preferred embodiment, the steering wheel 8 and the single lever control 10 are located on this horizontally inclined shelf 46 for easy access to the operator standing or sitting behind the center console.

Above and at the forward edge of the horizontally inclined shelf 46 is a first left vertically inclined wall 48 and second right vertically inclined wall 50, with the second wall 50 being stepped forwardly from the first vertically inclined wall 48. In a preferred embodiment, the engine indication instruments are clustered on the first vertical wall for easy reading by the operator of the boat 2 as he stands behind the steering wheel 8 also positioned on the left side of the console.

The second vertical wall 50 comprises a major opening 52, preferably substantially rectangular in shape. In a preferred embodiment, this opening is covered by a lockable sliding door 54 when the door is in the closed position. The door 54 slides left to open and right to close on a track 56 which extends above and below the opening 52 and behind the first wall 48 so that when the door is in the open position, it fills a part of the space 34 behind the first vertical inclined wall 48.

As stated earlier, electronic positioning instrumentation 14 can be easily stored in the space behind the second vertically inclined wall 50, and this instrumentation can be locked within the console when the operator of the boat is not on the craft, but can be readily utilized by sliding the door to the left behind engine instruments 12 and their associated wiring on the first vertically inclined wall 48. By utilizing a sliding door, which retreats into the space within the console, there is no door which can be bumped by the operator of the craft or a passenger while the craft is under way and the door is in the open position. Moreover, the appearance of the console is neat and clean both while the boat is unattended as well as while it is in use.

In a preferred embodiment, the lock 88 on the door 54 comprises an upper lever 90 and lower button 92. By pushing the lower button, the upper lever swings outwardly to act as a handhold to slide the door 54 open or closed.

The console 6 also comprises a horizontal top 58. In one embodiment, the top 58 may also have a cut out for a compass or other instrument. Also, around the bottom of the center console is a base portion 60 which acts to hold the console firmly in place on the deck of the cockpit of the boat 2. In a preferred embodiment, this base portion has a stepped-in contour which acts as a toe space around the console for the operator.

As stated earlier, in a preferred embodiment the center console 6 comprises a modular storage enclosure 16 which is recessed in an aperture 42 in the right side wall. The modular storage enclosure 16 comprises a first box 62 having a top wall 64, a pair of side walls 66 and a bottom wall 68. Around the front edge of each of these walls and extending outwardly therefrom is a lip 70 which also covers a portion of the right side wall 36 of the center console to cover the right side wall 36 immediately around the aperture 42. Fastening means (not shown) are provided to attach the modular storage enclosure 16 to the side wall 36 in a known manner. The rear of the first box 62 comprises a rear wall 72 while the front of the box is substantially open. Covering the box and hingedly attached to the lip along one side is a lockable door 74 which encloses the front side of the box 62 when the door is in the closed position. In one embodiment, a seal may be positioned between the door and the lip 70 in order to enhance the water repellency of the enclosure.

Extending rearwardly from the rear wall of the first box 62 is a second box 76 comprising top and bottom walls 78 and left and right walls 80. The second box also comprises a rear wall 82. The front of the second box 76 is open for access into the second box from the first box 62. The second box is sized and adapted to accept a flare gun kit.

Positioned above the second box 76 and also extending rearwardly from the rear wall 72 of the first box 62 is at least one and preferably three elongated navigational chart tubes 84. Each of these tubes is cylindrical in shape and may contain a rear wall 86. The front of each of these cylindrical tubes is open allowing access to the tube from the first box 62 to accept a rolled up navigational chart.

As can be seen by the above description, even though the boat 2 is relatively open, the center console provides lockable storage and convenient access to a multiplicity of equipment needed on the boat.

Although the preceding description and appended drawings are relatively detailed, it is to be understood that they are for the purpose of illustrating and not limiting the present invention, the scope of which is to be defined by the following claims.

I claim:

1. A center console for a boat comprising a front side, a back side, a left side and right side, said sides defining a space therebetween, said back side also having a lower portion defining a vertical wall, a horizontally inclined shelf above said vertical wall, and first and second generally parallel, laterally adjacent, vertically inclined walls extending upwardly from said shelf, said second vertically inclined wall being stepped forwardly from said first vertically inclined wall and said second vertically inclined wall having therein an opening, and a door closing said opening when in a closed position and located directly behind said first vertically inclined wall when in an open position.

2. The center console of claim 1 wherein said front side also comprises a lower portion defining a vertical wall and a generally horizontal seat above said vertical wall of said front side.

3. The center console of claim 1 wherein said first vertically inclined wall is substantially solid and is adapted to carry engine instruments.

4. The center console of claim 3 wherein said left and right sides each include a lower portion defining a vertical wall, wherein one of said vertical walls of said left and right sides has a modular recessed enclosure covered by a door and containing space adapted for storage of a fire extinguisher and a navigational chart.

5. The center console of claim 4 wherein said one vertical wall includes a cut out, and wherein said enclosure is encircled by a lip and said lip covers the edges of said cut out.

6. The center console of claim 1 wherein each of said back side, left side, and right side includes a lower portion defining a vertical wall, and wherein one of said vertical walls has a large cut out for access to said space.

7. The center console of claim 1 wherein the horizontally inclined shelf is adapted to carry a steering wheel, a throttle and a gear shift lever.

8. A center console for a boat, said console comprising a front side, a back side, a left side, and a right side, said sides defining therebetween a space, said left and right sides each including a lower portion defining a generally vertical wall, one of said vertical walls of said left and right sides having a modular recessed enclosure covered by a door and containing space adapted for storage of a fire extinguisher and a navigational chart, said back side including a lower portion defining a vertical wall, a horizontally inclined shelf above said back side vertical wall, and first and second generally parallel vertically inclined walls extending upwardly from said shelf, said second vertically inclined wall being stepped forwardly from said first vertically inclined wall and said second vertically inclined wall having therein an opening, and a door closing said opening when in a closed position and located directly behind said first vertically inclined wall when in an open position.

9. The center console of claim 8 wherein said one vertical wall includes a cut out having an edge, and wherein said enclosure is encircled by a lip which covers said edge.

* * * * *